US012715641B2

(12) United States Patent
Delén

(10) Patent No.: US 12,715,641 B2
(45) Date of Patent: Aug. 25, 2026

(54) DEVICE FOR REDUCING PRESENCE OF MICROORGANISMS ON WEB MATERIAL

(71) Applicant: Tetra Laval Holdings & Finance S.A., Pully (CH)

(72) Inventor: Anders Delén, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 19/132,931

(22) PCT Filed: Nov. 13, 2023

(86) PCT No.: PCT/EP2023/081547

§ 371 (c)(1),
(2) Date: May 27, 2025

(87) PCT Pub. No.: WO2024/115080

PCT Pub. Date: Jun. 6, 2024

(65) Prior Publication Data

US 2026/0192961 A1 Jul. 9, 2026

(30) Foreign Application Priority Data

Nov. 30, 2022 (EP) ..... 22210407

(51) Int. Cl.
*B65B 55/10* (2006.01)

(52) U.S. Cl.
CPC ..... *B65B 55/103* (2013.01)

(58) Field of Classification Search
CPC ..... B65B 55/103
See application file for complete search history.

(56) References Cited

U.S. PATENT DOCUMENTS 3,371,509 A * 3/1968 Dungler ..... D06B 19/0035 68/5 E
4,462,332 A * 7/1984 Nath ..... C23C 16/545 414/217

(Continued)

FOREIGN PATENT DOCUMENTS

| | | | |
|---|---|---|---|
| CN | 113350547 | A | 9/2021 |
| DE | 112019000944 | T5 | 11/2020 |
| EP | 1007414 | B1 | 6/2005 |

OTHER PUBLICATIONS

International Search Report mailed Jan. 8, 2024, for International Application No. PCT/EP2023/081547.

*Primary Examiner* — Thomas M Wittenschlaeger
(74) *Attorney, Agent, or Firm* — Renner, Otto, Boisselle & Sklar

(57) ABSTRACT

A device for reducing presence of microorganisms on a web material for example in a system for manufacture of packages, comprises a housing that defines an interior space, and a microorganism mitigation arrangement in the interior space. Inlet and outlet ports are arranged on the housing to allow the web material to move along a travel path through the interior space between the inlet and outlet ports. The inlet and outlet ports are elongated and comprise a respective seal that defines an elongated slit for flexing engagement with the web material. The device further comprises a spacer which is arranged in the elongated slit of one of the inlet and outlet ports to reduce engagement between the seal and the flat surfaces of the web material at one of its longitudinal edges.

15 Claims, 5 Drawing Sheets

(56) References Cited

U.S. PATENT DOCUMENTS

| | | | | | |
|---|---|---|---|---|---|
| 4,616,914 | A * | 10/1986 | Buelens | G03B 27/588 | 242/348.4 |
| 4,888,155 | A * | 12/1989 | Posey | B65B 55/103 | 422/106 |
| 5,008,076 | A * | 4/1991 | Johansson | B65B 55/103 | 53/425 |
| 5,114,671 | A * | 5/1992 | Olanders | B65B 55/103 | 34/640 |
| 5,356,592 | A * | 10/1994 | Balla | B65B 55/103 | 422/23 |
| 5,435,499 | A * | 7/1995 | Hirose | G03B 17/30 | 396/514 |
| 6,089,543 | A * | 7/2000 | Freerks | F16K 3/0227 | 251/356 |
| 10,113,651 | B2 * | 10/2018 | Coppola | F16K 3/0227 | |
| 2001/0017022 | A1 * | 8/2001 | Siccardi | B65B 55/02 | 53/451 |
| 2018/0319527 | A1 * | 11/2018 | Ghirardello | A61L 2/087 | |
| 2023/0372557 | A1 * | 11/2023 | Apparuti | A61L 2/087 | |

* cited by examiner

DEVICE FOR REDUCING PRESENCE OF MICROORGANISMS ON WEB MATERIAL

TECHNICAL FIELD

The present disclosure relates to a device for reducing presence of microorganisms on a web material, in particular a web material for use in production of packages.

BACKGROUND ART

It is vital to reduce presence of microorganisms during production of certain types of packages, for example packages that contain food products. This may be achieved by disinfection or sterilization.

One type of package is manufactured from a web material, which is cut and shaped into a package and filled with a food product. The web material may be a fiber-based laminate, for example comprising a core layer of paper or paperboard and one or more barrier layers of plastic. The packages are manufactured in a production line that includes one or more conventional filling machines.

Disinfection or sterilization may be performed at different stages in the production line. It is common practice to disinfect the incoming web material to prevent contamination of downstream equipment in the production line. The disinfection may be performed by feeding the web material through a disinfection device or unit, in which the web material is subjected to disinfection. Ports on the disinfection device may be provided with flexing seals that engage the passing web material so that the disinfection is performed in an effectively closed space within the housing. Alternatively or additionally, a corresponding sterilization device may be arranged in the production line to perform a sterilization of the web material.

Industrial production of packages is automated and designed for high-volume production. Standstill of production for service and maintenance is costly. One problem is dust accumulation in or on the disinfection/sterilization device. Accumulation of dust within the device may hamper the disinfection/sterilization of the web material. The device therefore needs to be periodically dismantled and cleaned, which takes significant time and causes standstill of production. It is desirable to reduce the need to clean the device.

SUMMARY

It is an objective to at least partly overcome one or more of the above-identified limitations of the prior art.

One such objective is to provide a device for reducing presence of microorganisms on a web material. Herein, reducing presence of microorganisms means reducing presence of microorganisms that are alive, which may comprise both disinfection and sterilization.

Another objective is to provide such a device that requires less downtime for cleaning.

One or more of these objectives, as well as further objectives that may appear from the description below, are at least partly achieved by a device for reducing presence of microorganisms on a web material, and a system for manufacturing of packages according to the independent claims, embodiments thereof being defined by the dependent claims.

A first aspect relates to a device for reducing presence of microorganisms on a web material that comprises opposite flat surfaces and longitudinal edges joining the opposite flat sides. The device comprises a housing that defines an interior space; and an inlet port and an outlet port, which are arranged on the housing to allow the web material to move along a travel path through the interior space between the inlet port and the outlet port. The inlet and outlet ports are elongated and comprise a respective seal, which defines an elongated slit for flexing engagement with the web material. The device further comprises an arrangement for reducing presence of microorganisms on the web material within the interior space. The device further comprises a spacer which is arranged in the elongated slit of the inlet port or the outlet port to reduce engagement between the seal and the flat surfaces of the web material at one of the longitudinal edges of the web material.

In some embodiments, the seal comprises a pair of opposing lips that are arranged to define the elongated slit, and the spacer is arranged between and in abutment with the opposing lips.

In some embodiments, the spacer has opposing sides that extend along the elongated slit and in abutment with the opposing lips to locally space the opposing lips from each other.

In some embodiments, the spacer has a surface arranged to face said one of the longitudinal edges, and a center point of the surface is aligned with a center line of the elongated slit.

In some embodiments, a distance between the opposing sides of the spacer is at least about 70% of a thickness of the web material, or equal to or larger than the thickness of the web material.

In some embodiments, the web material comprises a fibrous material.

In some embodiments, the fibrous material is exposed at said one of the longitudinal edges of the web material.

In some embodiments, the spacer is arranged to define a width of an elongated passageway for the web material through the elongated slit.

In some embodiments, the spacer is arranged to extend away from the elongated passageway along the elongated slit to an end of the elongated slit.

In some embodiments, a distance between the spacer and the end of the elongated slit is 0-5 mm, and preferably 0-3 mm.

In some embodiments, the spacer comprises an edge surface that is arranged to face said one of the longitudinal edges of the web material at a distance of 0.1-5 mm, and preferably 0.5-3 mm.

In some embodiments, the spacer is part of a releasable unit, which comprises a mounting portion for releasable attachment to the housing.

In some embodiments, the releasable unit is included in a kit of releasable units, and the spacers of the releasable units in said kit differ by at least one of thickness, width or location in relation to the mounting portion, wherein the thickness defines an extent of the spacer transversely to the elongated slit, and wherein the width defines an extent of the spacer along the elongated slit.

In some embodiments, the mounting portion is attached to the housing so that an end portion of the spacer projects through the elongated slit.

In some embodiments, the end portion has rounded edges as seen perpendicular to the flat surfaces of the web material.

In some embodiments, the spacer is arranged in the elongated slit of the outlet port, and the device comprises a further spacer which is arranged in the elongated slit of the inlet port to reduce engagement between the seal of the inlet port and the flat surfaces of the web material at said one of the longitudinal edges of the web material.

In some embodiments, said arrangement is operable to reduce the presence of microorganisms on the web material by providing one or more of: heat, a disinfection agent, a sterilization agent, ultraviolet radiation, or an electron beam.

A second aspect relates to a system for manufacture of packages. The system comprises a supply device for web material; a device according to the first aspect or any of its embodiments, which device is arranged to receive the web material from the supply device and operable to reduce presence of microorganisms on the web material; and a filling machine, which is configured to receive the web material from the device and process the web material into packages.

Still other objectives, embodiments, and aspects, as well as additional features and advantages will appear from the following detailed description as well as from the accompanying schematic drawings.

DETAILED DESCRIPTION

Embodiments will now be described more fully hereinafter with reference to the accompanying drawings, in which some, but not all, embodiments are shown. Indeed, the subject of the present disclosure may be embodied in many different forms and should not be construed as limited to the embodiments set forth herein; rather, these embodiments are provided so that this disclosure may satisfy applicable legal requirements.

Where possible, any of the advantages, features, functions, devices, and/or operational aspects of any of the embodiments described and/or contemplated herein may be included in any of the other embodiments described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "at least one" or "one or more", even though the phrase "one or more" or "at least one" is also used herein. The terms "multiple", "plural" and "plurality" are intended to imply provision of two or more elements. The term "and/or" includes any and all combinations of one or more of the associated listed elements. Although the terms first, second, etc. may be used herein to describe various elements, these elements should not be limited by these terms. These terms are only used to distinguish one element from another. For example, a first element could be termed a second element, and, similarly, a second element could be termed a first element, without departing the scope of the present disclosure.

Well-known functions or constructions may not be described in detail for brevity and/or clarity. Unless otherwise defined, all terms (including technical and scientific terms) used herein have the same meaning as commonly understood by one of ordinary skill in the art to which this disclosure belongs.

Like reference signs refer to like elements throughout.

Figure 1A:
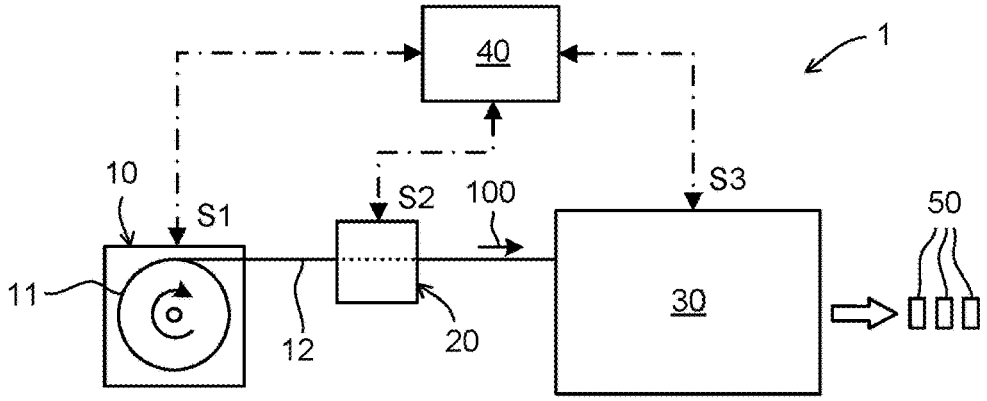
FIG. 1A is a schematic view of an operating system for manufacture of packages.

FIG. 1A is a schematic overview of an example system 1 for manufacturing packages 50. The packages 50 may contain any type of product. In the following, it is assumed that the packages 50 are filled with a food product. In the illustrated example, the manufacturing system 1 includes a web supply device 10, a device 20 for reducing presence of microorganisms, and a filling machine 30. The web supply device 10 comprises a roll 11 of web material 12, which is fed through the device 20 and into the filling machine 30. The filling machine 30 is configured to form a section of the web material 12 into a container, fill the container, and seal the filled container, to produce the packages 50. Typically, the filling machine 30 is configured to cut, fold and shape the incoming web material into containers. The filling machine 30 may of any conventional type and may be of unitary structure or a combination of physically separate units.

Figure 1B:
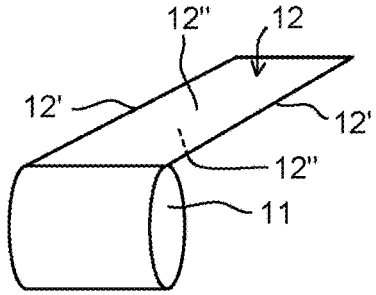
FIG. 1B is a perspective view of rolled-up web material for use in the system of FIG. 1A.

The web material 12 ("web") is a flat sheet of any suitable material. The present disclosure is not limited to any specific composition of the web 12. However, in many systems for manufacture of packages, the web 12 comprises a cellulose-based material, such as paper or paperboard, which may or may not be laminated with one or more layers of plastic material and/or metal, on one or both sides. The cellulose-based material contains fibers. Any material that contains fibers of any type is a "fibrous material" in the context of the present disclosure. The web 12 is typically provided in rolled-up form to the web supply device 10. Such a roll 11 of web material is shown in FIG. 1B. The web 12 that is withdrawn from the roll 11 has two opposing flat surfaces 12", which are joined by longitudinal edges 12'. In other words, the flat surfaces 12" are bounded by the edges 12' along the web 12.

The device 20 is configured to receive and process the web 12 to reduce presence of microorganisms thereon. As used herein, the term "microorganism" refers to any microscopic organism including but not limited to bacteria, fungi, archaea, protists, viruses, prions, etc. Depending on implementation, the device 20 may be configured to perform a disinfection or a sterilization of the web 12. As used herein, "disinfection", is a process that inactivates or destroys many but not necessarily all microorganisms, whereas "sterilization" refers to a process that removes, kills, or deactivates all microorganisms. For simplicity, the device 20 is referred to as a "disinfection device" in the following, although it may instead be used for sterilization.

One reason for installing the disinfection device 20 is to mitigate propagation of microorganisms to downstream equipment in the manufacturing system 1. This is particularly relevant in packaging of food products, where sanitary requirements are high. The disinfection device 20 need not be located upstream of the filling machine 30, as shown in FIG. 1A, but may be installed at any location within the filling machine 30. It should also be noted that the disinfection device 20 may be supplemented by further equipment for disinfection or sterilization within the filling machine 30.

The manufacturing system 1 is operated by one or more controllers, schematically represented by a control unit 40 in FIG. 1A. The control unit 40 is configured to provide control signals and receive feedback signals. These signals are schematically designated S1, S2 and S3 and represented by double-ended arrows (dot dashed) in FIG. 1A.

As indicated by an arrow 100, the web 12 is fed from the supply device 10 through the disinfection device 20 and into the filling machine 30. It is understood that the system 1 comprises one or more web feeding mechanisms, for example in the filling machine 30 and/or as a separate component.

Figure 2:
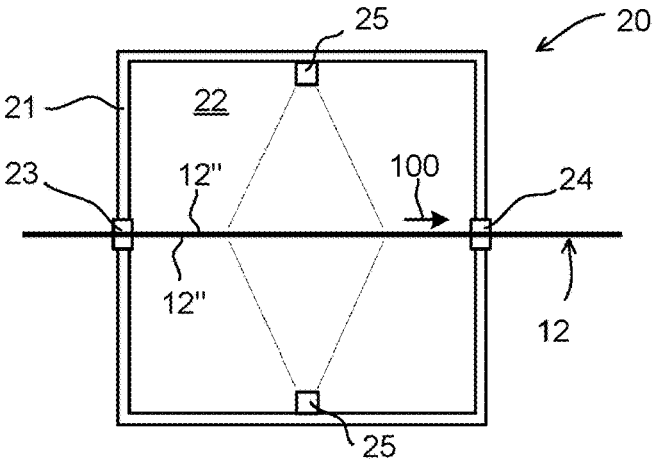
FIG. 2 is a section view of an example disinfection device in the operating system of FIG. 1A.

FIG. 2 is a section view of an example disinfection device 20 during operation. The disinfection device 20 comprises a housing 21 that defines an interior space 22, in which the web 12 is processed for disinfection or sterilization. Inlet and outlet ports 23, 24 are arranged on the housing 21 to receive the web 12. The respective port 23, 24 is elongated and adapted to pass the web 12. The web 12 enters the device 20 through the inlet port 23, traverses the space 22 on a travel path, and leaves the device 20 through the outlet port 24. Typically, the web 12 is continuously fed through the device 20 in the feed direction 100 during operation of the filling machine 30. The device 20 also comprises an arrangement 25 for reducing the presence of microorganisms on the web 12. For simplicity, the arrangement 25 is denoted "microorganism mitigation arrangement" or MMA in the following. In FIG. 2, the MMA 25 is represented by two processing units, one above and one beneath the travel path of the web 12 within the space 22. The respective processing unit may be an emitter of radiation or a port for injection of a disinfection/sterilization substance. Any number of processing units may be provided within the space 22. In some embodiments, the MMA 25 is configured to subject the web 12 to ultraviolet (UV) radiation, e-beam radiation, one or more disinfectants, one or more sterilization agents, or heat, or any combination thereof. Non-limiting examples of commonly used disinfectants and sterilization agents include hydrogen peroxide, ethylene oxide, peracetic acid, formaldehyde, ozone, chlorine dioxide, etc.

Although not shown in FIG. 2, a web guiding unit may be located on the upstream side and/or on the downstream side of the disinfection device 20, to accurately position the web 12 in relation to the inlet and outlet ports 23, 24. Such web guiding units are well-known in the art.

It may also be noted that the travel path of the web 12 through the disinfection device 20 need not be horizontal but could have any direction in relation to the direction of gravity. Thus, the disinfection device 20 in FIG. 2 could have any orientation.

Figure 3A:
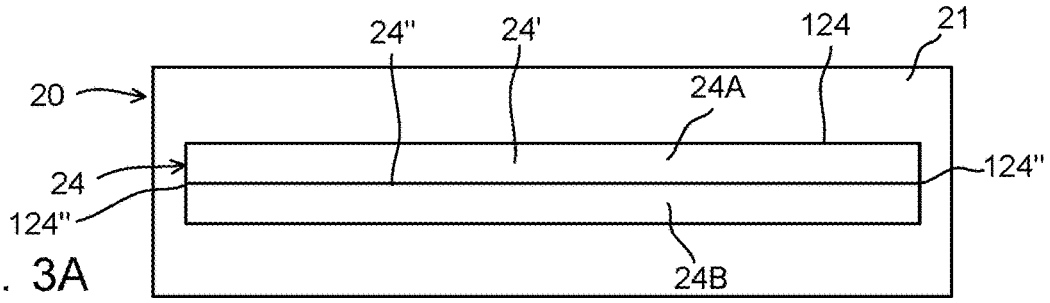
FIG. 3A is a side view towards an outlet port of an example disinfection device before installation of a spacer.

The disinfection or sterilization that is performed in the device 20 typically involve substances that are potentially harmful to humans. These substances may be provided by the MMA 25 or be generated during disinfection/sterilization. There is thus a need to mitigate uncontrolled release of substances from the space 22 in the device 20 to the surroundings. To this end, the ports 23, 24 are provided with flexible sealing elements. An example of such a port is shown in FIG. 3A, which is a partial side view of the device 20 in FIG. 2, depicting the outlet port 24. No web is present in FIG. 3A. The outlet port 24 is formed by an access opening 124 in the housing 21. A seal 24' is fitted to cover the access opening 124. The seal 24' defines an elongated slit 24" which extends between two slit ends 124". In the illustrated example, the slit 24" has a linear (straight) shape to conform with the flat shape of the web 12. The slit 24" is defined between an upper lip 24A and a lower lip 24B. At least one of the lips 24A, 24B is flexible to accommodate the web 12 within the slit 24". In one embodiment, the seal 24' is unitary and made of a flexible material, for example rubber or silicone, and the slit 24" is provided as a through-cut in the flexible material. In the embodiments described hereinbelow, it is assumed that both lips 24A, 24B are flexible.

Figure 3B:
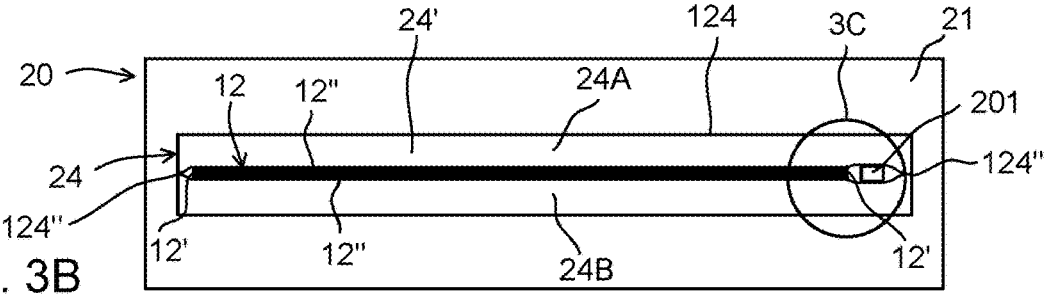
FIG. 3B is a side view towards the outlet port in FIG. 2A after installation of a spacer and during operation of the disinfection device.

FIG. 3B is a side view corresponding to FIG. 3A but with a web 12 arranged to extend through the seal 24'. The seal 24' is in flexing engagement with the web 12, by the flexing of the lips 24A, 24B. The present Applicant has identified a potential problem with this structure of the disinfection device 20, in the form of significant accumulation of dust inside the housing 21, for example on the inside of the seal 24'. The accumulated dust impacts the performance of the device 20 and need to be periodically removed by manual cleaning. The manual cleaning is quite time consuming, since the housing 21 needs to be dismantled and then reassembled. To reduce downtime of the manufacturing system 1, the dust-containing device 20 may be replaced for an identical device 20 and cleaned off-line. However, the replacement operation is also quite time-consuming and results in downtime of the manufacturing system 1. The Applicant has also observed a similar accumulation of dust on the outside of the inlet port 23. This dust is easier to remove since it is on the outside of the housing 21. The Applicant has concluded that the dust is mainly caused by abrasion, resulting from the closing of the slit 24" at the edge 12' of the web 12. The abrasion results in dust when the web 12 comprises a fibrous material, and in particular when the fibrous material is exposed at the edge 12'. In the example of FIG. 3B, the right-hand edge 12' of the of the web 12 is uncoated, causing fibrous material to be exposed and vulnerable to abrasion.

Figure 3C:
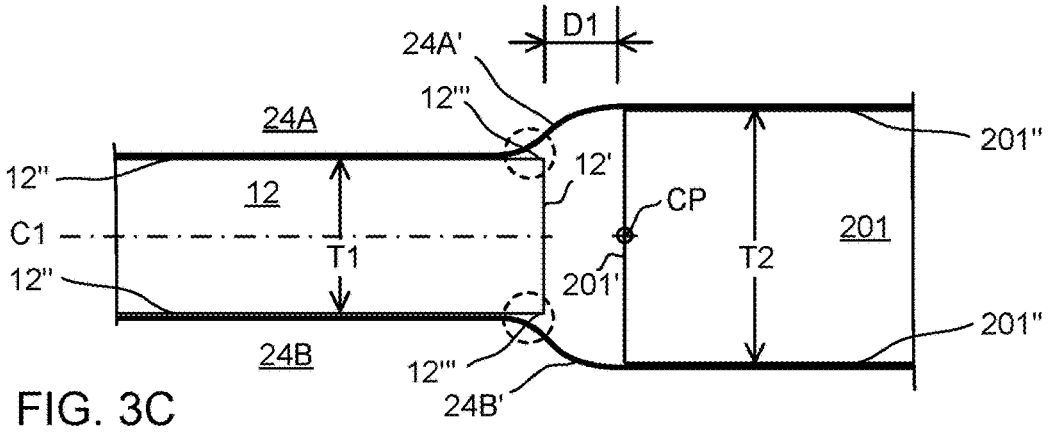
FIG. 3C is an enlarged view of a portion of FIG. 3B.

After significant experimentation, the Applicant has found a simple yet effective solution to this problem. The solution involves, as shown in FIG. 3B, installation of a spacer 201 in the slit 24", adjacent to the longitudinal edge 12' that is vulnerable to abrasion, to reduce the engagement between the seal 24' and the flat surfaces 12" of web 12 at this longitudinal edge 12'. The spacer 201 is fixed and acts as a separation element, distance piece, or spacing element. In the example of FIG. 3B, the spacer 201 is arranged between and in abutment with the lips 24A, 24B of the seal 24'. The spacer 201 is arranged to define an elongated passageway for the web 12 through the slit 24", to the left of the spacer 201 in FIG. 3B. FIG. 3C is an enlarged view of the encircled portion 3C in FIG. 3B. In the illustrated example, the spacer 201 is arranged in abutment with the lip surfaces 24A', 24B' that delimit the slit 24". The spacer 201 drives the lips 24A, 24B apart to relax the forces acting on the web 12 in the encircled regions (dashed lines) in FIG. 3B, specifically at the end portions 12'" of the flat surfaces 12" adjacent to the edge 12'. In the illustrated example, the spacer 201 is configured to separate the lips 24A, 24B to effectively eliminate contact between the seal 24' and the end portions 12" on both sides of the web 12.

In the illustrated example, the spacer 201 has opposing sides 201", which are configured to face the lips 24A, 24B, and an edge surface 201', which is configured to face the elongated passageway. The edge surface 201' thereby faces the edge 12' of the web 12 when the web 12 is located in the passageway as shown in FIGS. 3B-3C. In the illustrated example, the opposing sides 201" are flat and mutually parallel, which may reduce the stress on the seal 24" since the forces acting on the lips 24A, 24B are distributed along the sides 201". However, other shapes and arrangements of the opposing sides 201" are conceivable. For example, the sides 201" may be curved and or be inclined away from the edge surface 201'. Irrespective of shape, the spacer 201 may be arranged with its opposing sides 201" extending along the slit 24" and in abutment with the lips 24A, 24B to locally space the lips 24A, 24B from each other.

It may also be advantageous for the center point CP of the edge surface 201' to be aligned with the center line C1 of the slit 24". The center point CP is located midway between the opposing sides 201". The center line C1 is located midway between the lip surfaces 24A', 24B' when the seal 24' is relaxed or unloaded. The center line C1 will generally coincide with a symmetry line of the web 12. The symmetry line extends between the edges 12' of the web 12 and midway between the flat surfaces 12". By aligning the center point CP with the center line C1, the separating effect of the spacer 201 is equally distributed between the flat sides 12" of the web 12, resulting in an approximately equal relaxation of forces at the end portions 12". In the context of the present disclosure, CP and C1 are considered to be aligned if the offset between CP and C1 is less than 25% of the thickness of the web 12.

In FIG. 3C, the edge surface 201' of the spacer 201 is flat and arranged at right angles to the sides 201". In practice, the edge surface 201' may have any shape and inclination.

As indicated in FIG. 3C, the edge surface 201' of the spacer 201 is arranged at a distance D1 from the (closest) edge 12' of the web 12. If the edge surface 201' has an irregular shape and/or is inclined, the distance D1 is the shortest distance between the edge surface 201' and the edge 12'. In some embodiments, D1 is in the range of 0.1-5 mm. This will enable the spacer 201 to relax forces from the seal 24' on the end portions 12" of the web 12. In a commercial installation, D1 may be in the range of 0.5-3 mm. Deployment of the device 20 is facilitated, for example in view of tolerances, if D1 is about 0.5 mm or larger. The upper limit of about 3 mm is currently believed to enable adequate force relaxation for spacers 201 of reasonable thickness, while also limiting the size of the gap between the spacer 201 and the web 12. The size of the gap should be kept small to contain potentially harmful substances within the interior space 22 of the device.

It may be noted that the spacer 201, irrespective of shape and thickness, will result in a relaxation of forces at the end portions 12". Thus, a relaxation will be achieved also if the spacer 201 is thinner than the web 12. In FIG. 3C, T1 represents the thickness of the web 12, given as the distance between the flat surfaces 12" of the web 12, and T2 represents the thickness of the spacer 201, given as the distance between the opposing sides 201". If the spacer 201 has an irregular shape, the thickness T2 is the distance between the opposing sides 201" at the edge surface 201'. It is currently believed that adequate relaxation of the forces at the end portions 12" is achieved for $T2 \geq \alpha \cdot T1$, with a being about 0.70. In some embodiments, for more efficient relaxation, a is about 1.0 or larger, for example at least 1.1 or 1.2.

Figure 4A:
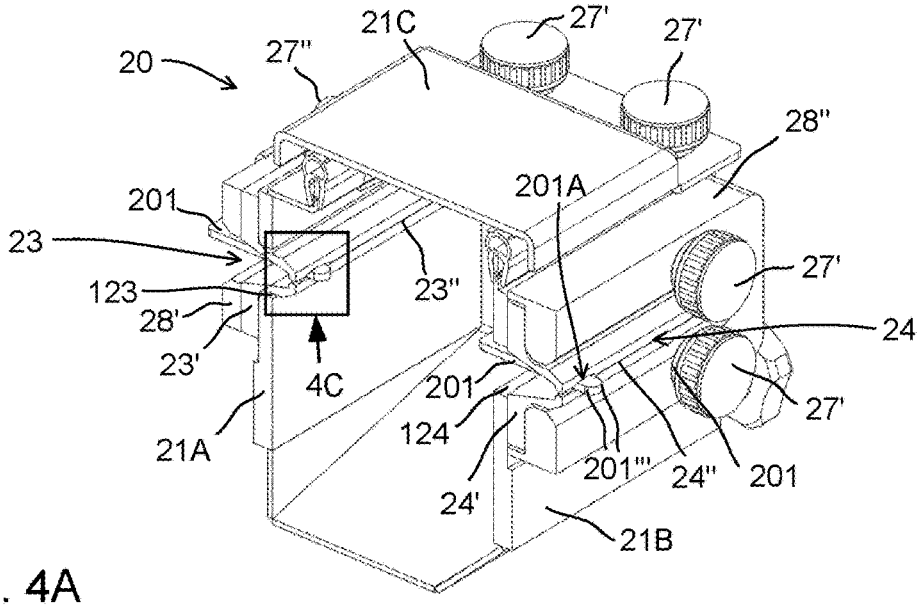
FIGS. 4A-4B are sectioned perspective views of an example disinfection device with narrow spacers.
Figure 4B:
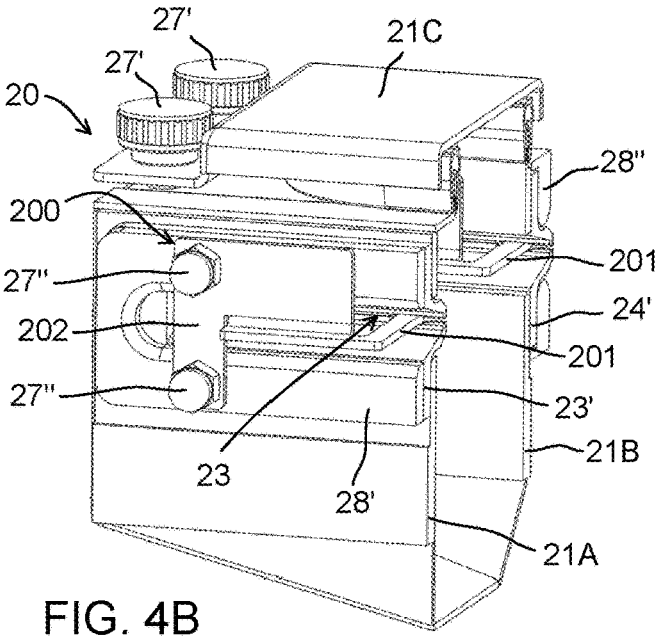

FIGS. 4A-4B are perspective views of an example disinfection device 20 in accordance with an embodiment. The perspective views are partly in section and taken from two different angles. The housing 21 of the device 20 comprises wall portions, some of which are part of a fixed frame structure and some being releasably attached to the frame structure. In the illustrated example, the frame structure comprises an inlet wall 21A and an outlet wall 21B, which define an inlet access opening 123 and an outlet access opening 124, respectively. A top lid 21C is releasably attached to the frame structure by bolts with knob handles 27', which are configured to facilitate manipulation by hand. The knob handles 27' thus form quick-release connectors that are simple to remove when the device 20 needs to be dismantled for cleaning or other maintenance. Any other type of quick-release connector may be used. An inlet seal 23' is arranged to cover the inlet access opening 123 and project into the housing 21. An inlet mounting plate 28' defines an opening that conforms in shape and position with the inlet access opening 123. The inlet seal 24' is sandwiched between the inlet mounting plate 28' and the inlet wall 21A. The inlet mounting plate 28' is attached to the inlet wall 21A by fasteners 27", which in this example are nuts screwed onto threaded ends (not shown) that are arranged to project from the inlet wall 21A through mounting holes (not shown) in the mounting plate 28' and in the seal 23'. An outlet seal 24' is arranged to cover the outlet access opening 124 and project out of the housing 21. An outlet mounting plate 28" defines an opening that conforms in shape and position with the outlet opening 124. The outlet seal 24' is sandwiched between the mounting plate 28" and the outlet wall 21B. The outlet mounting plate 28" is attached to the outlet wall 21B by fasteners, in this example bolts with knob handles 27'. The bolts extend through mounting holes (not shown) in the mounting plate 28", in the seal 24' and in the outlet wall 21B into engagement with nuts (cf. 27" in FIG. 5C) on the inside of the housing 21.

The inlet seal 23' and the access opening 123 are part of an inlet port 23, and the outlet seal 24' and the access opening 124 are part of an outlet port 24. The respective seal 23', 24' comprises an elongate slit 23", 24".

In FIGS. 4A-4B, a respective spacer 201 is arranged to extend through the slit 23" and the slit 24". For clarity of presentation, the web is omitted in FIGS. 4A-4B. Each spacer 201 is finger-shaped and thus has a narrow width along the slit 23", 24". The spacer 201 is part of a releasable unit 200 (FIG. 4B), which comprises a mounting portion 202 for releasable attachment to the housing. In the illustrated example, mounting portion 202 is plate-shaped and the spacer 201 extends at right-angles from mounting portion 202. At the inlet port 23, the mounting portion 202 is attached onto the outside of the housing with the spacer 201 extending into the housing through the slit 23". The mounting portion 202 comprises mounting holes for receiving the threaded ends that project through the mounting plate 28', and the mounting portion 202 is firmly attached to the housing by the engagement of the nuts 27" with the threaded ends. At the outlet port 24, the mounting portion (not shown) is attached onto the inside of the housing with the spacer 201 extending out of the housing through the slit 24". It is understood that FIGS. 4A-4B are merely examples and that the releasable units 200 may be attached to the housing by any suitable fastener or equivalent element.

As understood from FIG. 3B, the spacer 201 is arranged in the slit 23", 24" to define the available (open) passageway for the web 12 through the slit 23", 24". In some installations, the disinfection device 20 may need to accommodate webs 12 of different widths, necessitating an adjustment of the location of the edge surface 201' along the slit 23", 24". Such adjustment may be enabled by providing a kit of different releasable units 200, which all have similar mounting portions 202 and different spacers 201. The mounting portions 202 may be configured for attachment to the same fastening structure on the housing, such as threaded pins, guiding pins, mounting holes, etc. Between the different releasable units 200 in the kit, the spacer 201 may differ by width or location of the spacer 201 in relation to the mounting portion 202, or a combination thereof. The width is the extent of the spacer 201 along the slit 23", 24". An increased width may result in a decreased extent of the passageway. Likewise, the extent of the passageway may be adjusted by providing releasable units 200 which, when mounted to the housing, arrange the spacer 201 at different locations along the slit 23", 24". Such a kit increases the versatility of the disinfection device 20.

It is also conceivable for then kit to include releasable units 200 that have different thickness of their spacer 201, for example to be used with webs 12 of different thickness (T1 in FIG. 3C) and/or different sensitivity to abrasion.

As seen in FIG. 4A, a distal end 201A ("end portion") of the respective spacer 201 projects from the seal 23", 24". This distal end 201A is pressed through the slit 23", 24" when the spacer 201 is installed in the device 20. To reduce the risk of damaging the seal 23', 24', the distal end 201 has rounded edges 201''' as seen along the wall portion 21A, 21B perpendicular to the slit 23", 24", i.e., perpendicular to the flat surfaces 12" of the web 12 when the web 12 is arranged to extend through the ports 23, 24.

Figure 4C:
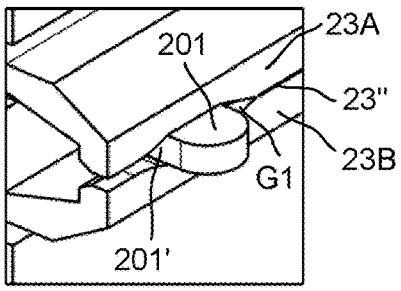
FIG. 4C is an enlarged view of a portion of FIG. 4A.

The present Applicant has found room for further improvement of the disinfection device 20 in FIGS. 4A-4B. The use of a finger-shaped spacer 201 facilitates installation of the spacer 201 in the slit 23", 24" and enables a relatively compact and light-weight releasable unit 200. FIG. 4C is an enlarged view of the rectangular portion 4C in FIG. 4A. As seen in FIG. 4C, the spacer 201 will not only serve to separate the lips 23A, 23B in relation to the web but also create a gap G1 between the lips 23A, 23B on the side of the spacer 201 that faces away from the web. The gap G1 is formed since the lips 23A, 23B will remain separated outside of the spacer 201 until they are able to flex back to the center line of the slit 23" (cf. C1 in FIG. 3C). The size of the gap G1 depends, for example, on the thickness of the spacer 201 and the flexibility of the lips 23A, 23B. If the gap G1 is too large, the device 20 may exhibit unacceptable leakage of potentially harmful substances during operation. A similar gap is formed by the spacer 201 in the slit 24".

Figure 5A:
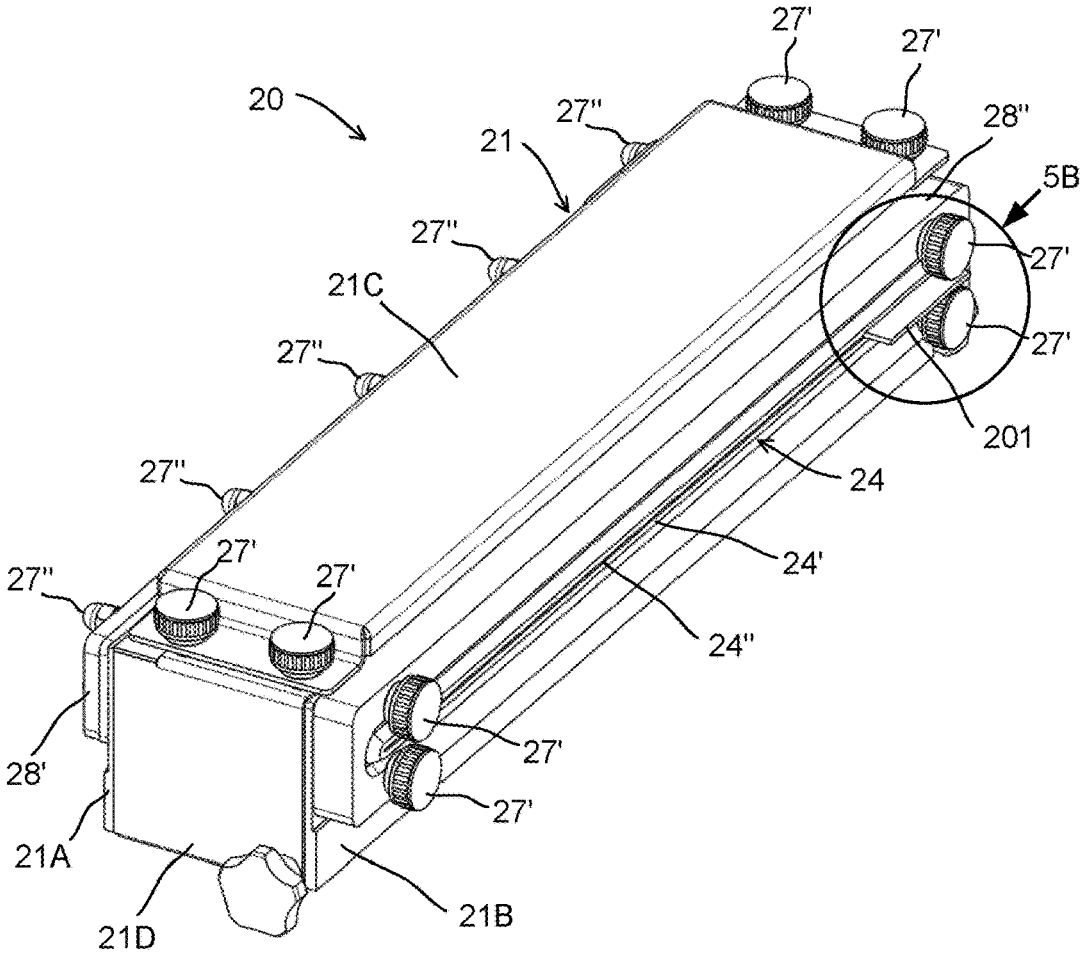
FIG. 5A is a perspective view of an example disinfection device with extended spacers.
Figure 5B:
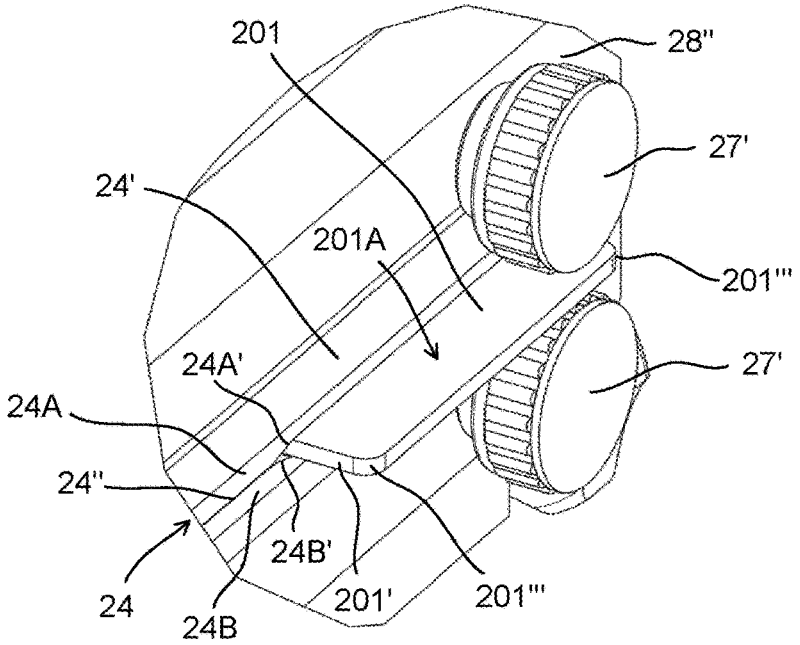
FIG. 5B is an enlarged view of a portion of FIG. 5A.
Figure 5C:
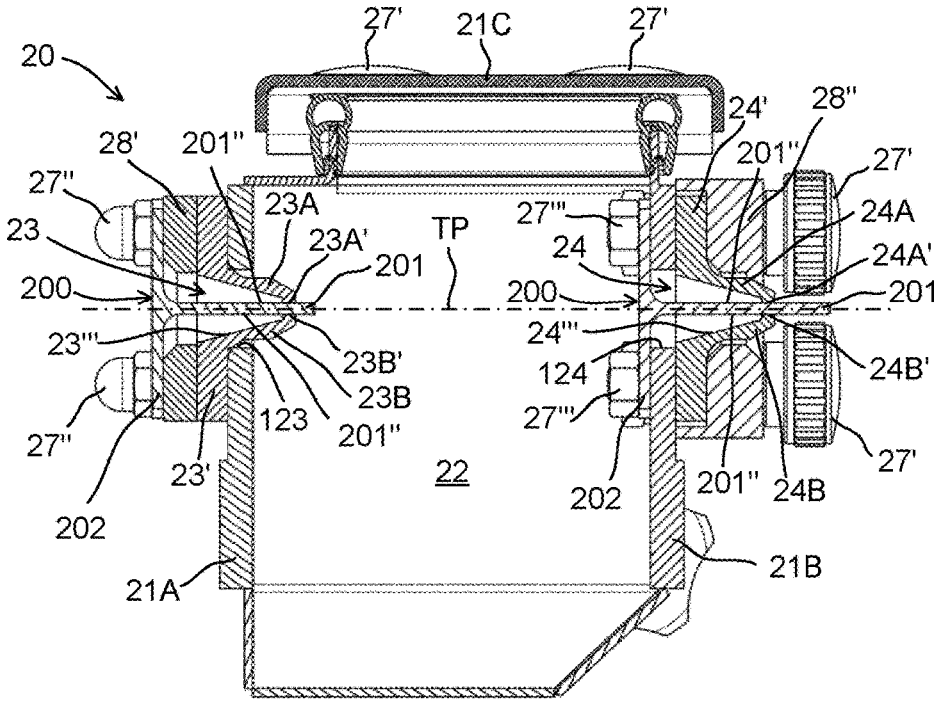
FIG. 5C is a section view of the disinfection device in FIG. 5A.

The risk of leakage may be mitigated by increasing the width of the spacer 201 along the slit. FIGS. 5A-5C depict an example disinfection device 20, which is provided with such a spacer 201. FIGS. 5A-5C show the disinfection device 20 without installation of a web. FIGS. 6A-6D show the same disinfection device 20 when a web 12 is fed through the device 12 during operation. The disinfection device 20 has the same basic structure and configuration as the device 20 in FIGS. 4A-4B. To avoid unnecessary repetition, the following description will focus on differences and details not seen in FIGS. 4A-4B. Details not described in the following are thus the same is in FIGS. 4A-4B.

As seen in the perspective view of FIG. 5A, the disinfection device 20 is elongated and has a housing in the general shape of a rectangular cuboid. The frame structure of the housing extends between two end walls 21D, 21E (FIG. 6A) and includes an inlet wall 21A and an outlet wall 21B. The top of the housing is closed by a top plate 21C. The mounting plate 28' on the inlet side is attached to the frame structure by a plurality of fasteners 27" (here, nuts) dispersed along the extent of the housing. The mounting plate 28" on the outlet side is attached to the frame structure by four bolts with knob handles 27', which form quick-release connectors. Despite the provisions of spacers 201, some dust may be generated when the device 20 is operated for an extended period of time, for example one or more weeks. Since dust is more likely to accumulate on the inside of the outlet seal 24', it may be beneficial to have quick-release connectors on the outlet side of the device 20 to provide easy access to the inside of the outlet seal 24". Further quick access to the inside of the housing is provided by the top lid 21C being releasably attached to the frame structure by four bolts with knob handles 27'.

FIG. 5B is an enlarged view of the encircled portion 5B in FIG. 5A. As seen, the spacer 201 has a significantly larger extent along the slit 24" compared to the spacer 201 in FIGS. 4A-4B. The spacer 201 is more blade shaped than finger shaped. Like in FIGS. 4A-4B, the spacer 201 has rounded edges 201''' on the distal end 201A that projects through the slit 24". Although not shown, the spacer 201 in the slit 23" has a similarly shaped distal end. As seen in the section view of FIG. 5C, the respective spacer 201 is part of a releasable unit 200 which is mounted to the housing as described above with reference to FIGS. 4A-4B. The releasable unit 200 may be included in a kit of releasable units, among which the spacers 201 differ by width and/or thickness.

Figure 6A:
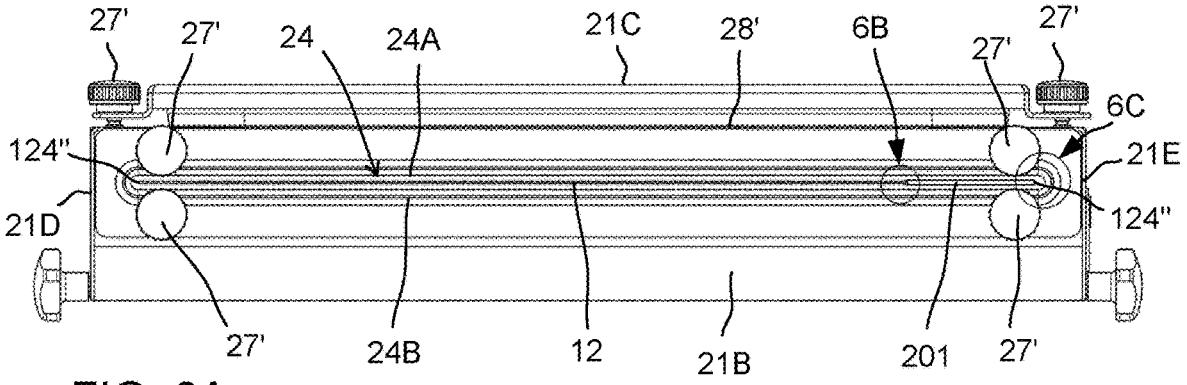
FIG. 6A is a side view towards an outlet port of the disinfection device in FIG. 5A during operation.

Turning to FIG. 6A, which is a front view of the outlet port 24, it is seen that the elongated slit 24" extends between two slit ends 124" and that the spacer 201 is arranged to extend all the way to the right-hand slit end 124". Thereby, the spacer 201 defines the width of the passageway for the web 12 in the slit 24" and blocks the rest of the slit 24". FIG. 6C is an enlarged view of the encircled portion 6C in FIG. 6A. By arranging the spacer 201 to exert a pressing force towards the slit end 124", it is possible to reduce or even eliminate the gap G2 between the edge surface 201' of the spacer 201 and the slit end 124". As indicated in FIG. 6C, the edge surface 201' of the spacer 201 is arranged at a distance D2 from the slit end 124". The distance D2 is set so that the area of the gap G2 is smaller than area of the gap G1 for the finger-shaped spacer 201 (cf. FIG. 4C). In some embodiments, D2 is in the range of 0-5 mm. In some embodiments, the upper limit of D2 is set to 3 mm, to further mitigate release of substances. A distance D2 close to zero may be achieved by deforming the slit end 124" and the adjacent lip surfaces 24A', 24B' into contact with the edge surface 201'. It may be noted that the edge surface 201' need not be planar and right angled as shown, but may be shaped to approximately match the triangular shape of the gap G2 shown in FIG. 6C, to reduce the stress on the seal 24' and the seal end 124".

Figure 6B:
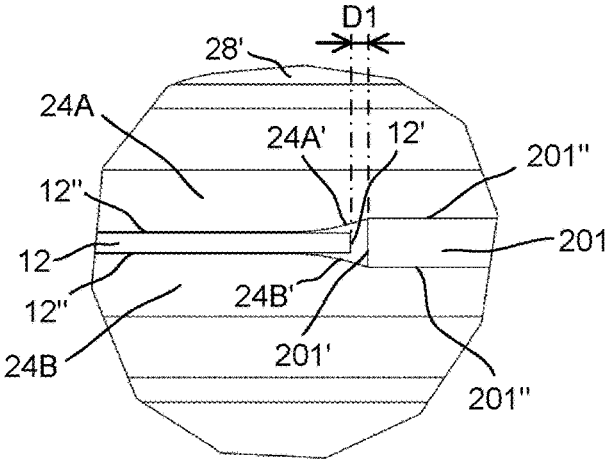
FIGS. 6B-6C are enlarged views of portions of FIG. 6A.
Figure 6C:
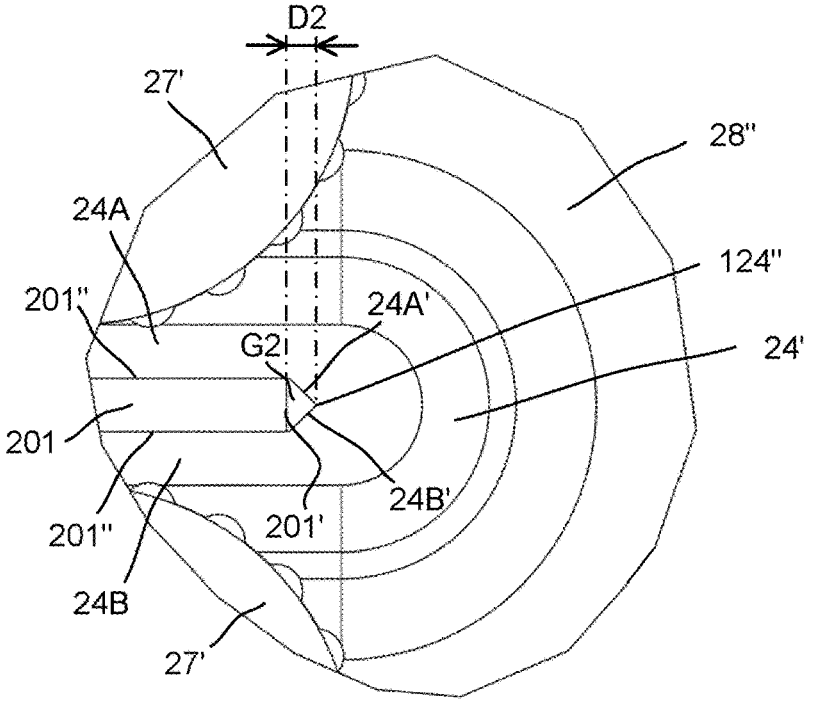
Figure 6D:
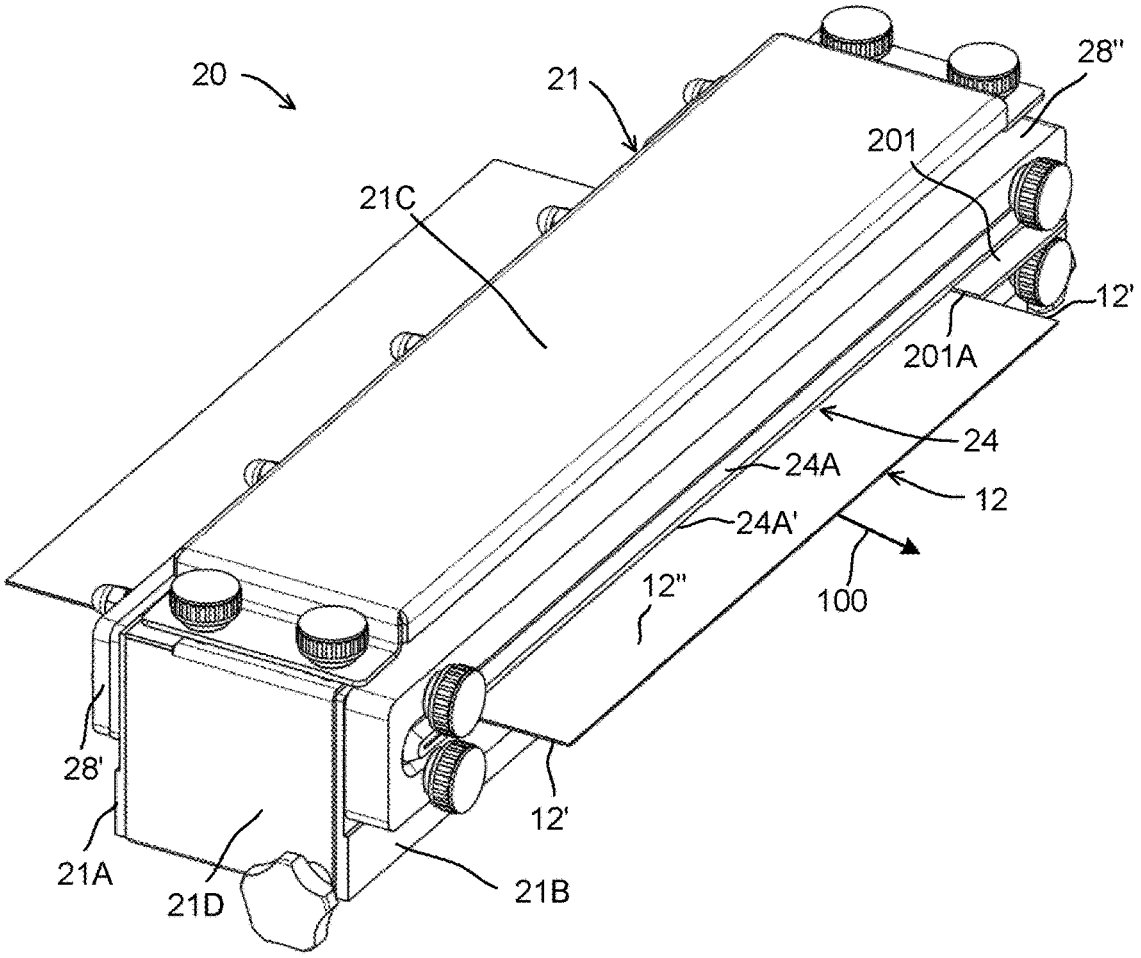
FIG. 6D is a perspective view of the disinfection device in FIG. 6A.

FIG. 6B is an enlarged view of the encircled portion 6B in FIG. 6A and shows how the spacer 201 achieves a forced separation of the lips 24A, 24B to such an extent that the lip surfaces 24A, 24B' are spaced from the flat surfaces 12" at the edge 12' of the web 12. FIG. 6B includes the distance parameter D1. The discussion above regarding D1 and other design parameters is equally applicable to the embodiment in FIGS. 5-6.

Reverting to the section view of FIG. 5C, it is seen that the seals 23', 24' are configured to project through the access openings 123, 124 of the housing 21. The inlet seal 23' is configured to project into the housing, and the outlet seal 24' is configured to project out of the housing. Thereby, the seals 23', 24' are arranged project in the feed direction of the web 12 along the travel path TP through the housing. The projecting shape of the seals 23', 24' makes it possible to configure the respective seal 23', 24' with guide surfaces 23", 24''' that extend along the seal 23', 24 and taper towards the slit 23", 24". The guide surfaces 23", 24''' face in a direction of opposite to the feed direction of the web 12 through the housing. This configuration of the seals 23', 24' may facilitate the task of inserting the web 12 into the respective slit 23', 24'. The web 12 will be guided through contact with the guide surfaces 23''', 24''' to and through the respective slit 23', 24'. It should be understood that the web 12 may be quite wide and difficult to handle as a result of twisting and curving.

In the examples of FIGS. 4-6, the disinfection device 20 has one spacer 201 in the inlet port 23 and one spacer 201 in the outlet port 24, with both spacers 201 being arranged to reduce engagement with the same edge 12' of the web 12. In some installations, it may be possible omit one of the spacers 201. For example, the spacer 201 in the inlet port 23 may be omitted if dust is mainly accumulated on the outside of the inlet port 23 and is thus easily accessible for cleaning. It is conceivable to instead omit the spacer from the outlet port 24. It is also conceivable to have two spacers in the inlet port 23 and/or the outlet port 24, on both sides of the web 12. This may, for example, be relevant if both of the longitudinal edges 12' of the web 12 are sensitive to abrasion.

The present disclosure is not limited to webs that comprise fibrous material or have a longitudinal edge that exposes the fibrous material, but may be used for any type of web to reduce the abrasion of one or both of the longitudinal edges of the web and/or to reduce the risk for jams, entanglement, tears, etc., caused by elevated frictional engagement between the longitudinal edge(s) of the web and an elongated seal of an inlet or outlet port.

The invention claimed is:

1. A device for reducing presence of microorganisms on a web material that comprises opposite flat surfaces and longitudinal edges joining the opposite flat sides, said device comprising:

a housing that defines an interior space, an inlet port and an outlet port, which are arranged on the housing to allow the web material to move along a travel path through the interior space between the inlet port and the outlet port, wherein the inlet and outlet ports are elongated and comprise a respective seal, which defines an elongated slit for flexing engagement with the web material, an arrangement for reducing presence of microorganisms on the web material within the interior space, said device further comprising:

a spacer which is arranged in the elongated slit of the inlet port or the outlet port to reduce engagement between the seal and the flat surfaces of the web material at one of the longitudinal edges of the web material.

2. The device of claim 1, wherein the seal comprises a pair of opposing lips that are arranged to define the elongated slit, and wherein the spacer is arranged between and in abutment with the opposing lips.

3. The device of claim 2, wherein the spacer has opposing sides that extend along the elongated slit and in abutment with the opposing lips to locally space the opposing lips from each other.

4. The device of claim 1, wherein the spacer has a surface arranged to face said one of the longitudinal edges, and wherein a center point of said surface is aligned with a center line of the elongated slit.

5. The device of claim 1, wherein a distance between the opposing sides of the spacer is at least about 70% of a thickness of the web material, or is equal to or larger than the thickness of the web material.

6. The device of claim 1, wherein the web material comprises a fibrous material.

7. The device of claim 6, wherein the fibrous material is exposed at said one of the longitudinal edges of the web material.

8. The device of claim 1, wherein the spacer is arranged to define a width of an elongated passageway for the web material through the elongated slit.

9. The device of claim 8, wherein the spacer is arranged to extend away from the elongated passageway along the elongated slit to an end of the elongated slit.

10. The device of claim 9, wherein a distance between the spacer and the end of the elongated slit is 0-5 mm, and preferably 0-3 mm.

11. The device of claim 1, wherein the spacer comprises an edge surface that is arranged to face said one of the longitudinal edges of the web material at a distance of 0.1-5 mm, and preferably 0.5-3 mm.

12. The device of claim 1, wherein the spacer is part of a releasable unit, which comprises a mounting portion for releasable attachment to the housing.

13. The device of claim 12, wherein the releasable unit is included in a kit of releasable units, wherein the spacers of the releasable units in said kit differ by at least one of thickness, width or location in relation to the mounting portion, wherein the thickness defines an extent of the spacer transversely to the elongated slit, and wherein the width defines an extent of the spacer along the elongated slit.

14. The device of claim 12, wherein the mounting portion is attached to the housing so that an end portion of the spacer projects through the elongated slit, wherein said end portion has rounded edges as seen perpendicular to the flat surfaces of the web material.

15. A system for manufacture of packages, said system comprising:

a supply device for web material, a device according to claim 1, which is arranged to receive the web material from the supply device and operable to reduce presence of microorganisms on the web material, and a filling machine, which is configured to receive the web material from the device and process the web material into packages.

* * * * *